US005522758A

United States Patent [19]

Liu et al.

[11] Patent Number: 5,522,758

[45] Date of Patent: Jun. 4, 1996

[54] TOY FLOWER DOLL APPARATUS

[75] Inventors: Dexter C. Liu, Portsmouth, R.I.; Douglas Melville, Jr., Simsbury, Conn.

[73] Assignee: Liu Concept Designs & Associates, Newport, R.I.

[21] Appl. No.: 514,713

[22] Filed: Aug. 14, 1995

Related U.S. Application Data

[63] Continuation of Ser. No. 186,871, Jan. 25, 1994, abandoned.

[51] Int. Cl.[6] ..... A63H 13/16

[52] U.S. Cl. ..... 446/310; 446/487; 40/411

[58] Field of Search ..... 446/310, 308, 446/314, 330, 352, 358, 359, 486, 487, 489, 298, 309, 311, 383, 167; 40/411, 414; 84/95.2, 94.2

[56] References Cited

U.S. PATENT DOCUMENTS

| | | | |
|---|---|---|---|
| 530,870 | 12/1894 | Wenger | 40/411 |
| 549,039 | 10/1895 | Wenger | 40/411 |
| 769,935 | 9/1904 | Brom | 446/310 X |
| 1,148,208 | 7/1915 | Allison . | |
| 1,916,988 | 7/1933 | Pieschke . | |
| 3,471,964 | 10/1969 | Cherry et al. | 446/268 |
| 3,597,877 | 8/1971 | Speers | 446/72 |
| 4,471,564 | 9/1984 | Beny | 446/486 |
| 4,910,647 | 3/1990 | Gong | 40/411 X |
| 5,090,569 | 2/1992 | Nissen et al. | 446/310 X |

FOREIGN PATENT DOCUMENTS

| | | | |
|---|---|---|---|
| 1558419 | 4/1990 | U.S.S.R. | 446/156 |

*Primary Examiner*—Mickey Yu

*Attorney, Agent, or Firm*—Panitch Schwarze Jacobs & Nadel

[57] ABSTRACT

The present invention provides a simulated flower having a center section and a plurality of petals pivotally mounted to the center section for movement between an open position and a closed position. A toy doll is supported on a doll holder member, which is disposed within the simulated flower center section. A mechanism is provided which operates to raise and lower the holder member, and consequently the doll, and to simultaneously pivot the petals between the open and the closed positions, respectively. When the petals are in the open position, the doll is exposed and when the petals are in the closed position, the doll is enveloped by the petals.

4 Claims, 5 Drawing Sheets

TOY FLOWER DOLL APPARATUS

This is a continuation of application Ser. No. 08/186,871, filed Jan. 25, 1994, now abandoned.

FIELD OF THE INVENTION

The present invention relates to a toy and, more particularly, a simulated flower toy having a toy doll disposed within the flower, the doll being exposed when the flower is in an open position and hidden when the flower is in a closed position.

BACKGROUND OF THE INVENTION

It is well known that flowers are beautiful and attractive. It is also known that toy dolls are a very popular child's toy. The present invention combines the beauty of a flower with the popularity of a toy doll. The toy flower-doll of the present invention provides a feminine alternative to male action toy figures.

SUMMARY OF THE INVENTION

Briefly stated, the present invention provides a simulated flower and toy doll apparatus. The simulated flower includes a center section having a holder member which supports the doll and a plurality of petals pivotally mounted to and generally surrounding the center section. The petals pivot between an open position, wherein the doll is exposed, and a closed position, wherein the petals envelop the doll. A drive mechanism is connected to the holder member for moving the holder member with respect to the petals, to move the doll, and for substantially simultaneously moving the petals between the open and closed positions.

BRIEF DESCRIPTION OF THE DRAWINGS

The foregoing summary, as well as the following detailed description of a presently preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangement and instrumentalities shown. In the drawings.

DETAILED DESCRIPTION OF THE PREFERRED EMBODIMENT

Figure 1:
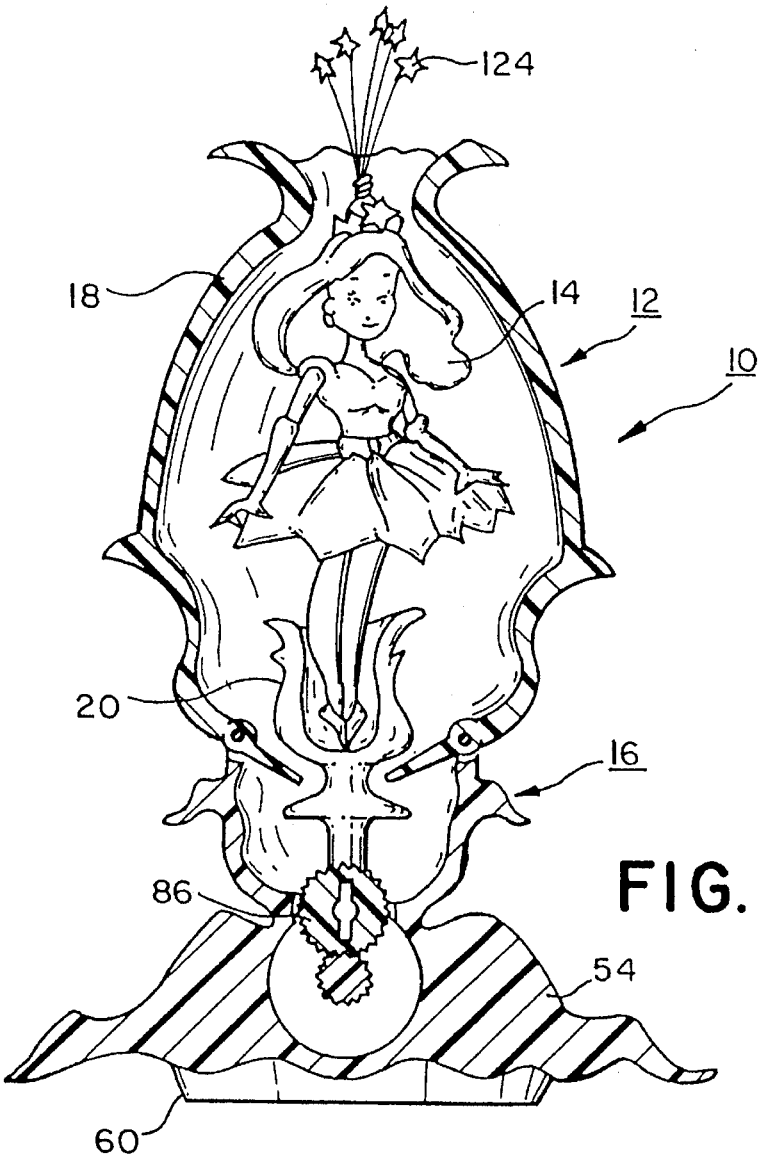
FIG. 1 is a cross-sectional side elevation view of a toy flower-doll in a closed position in accordance with a preferred embodiment of the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the toy figure and designated parts thereof. The terminology includes the words specifically mentioned above, their derivatives and words of similar meaning.

Referring to the drawings in detail, wherein like numerals indicate like elements throughout, there is shown a presently preferred embodiment of a toy flower-doll in accordance with the present invention, which is generally designated as element numeral 10.

Figure 2:
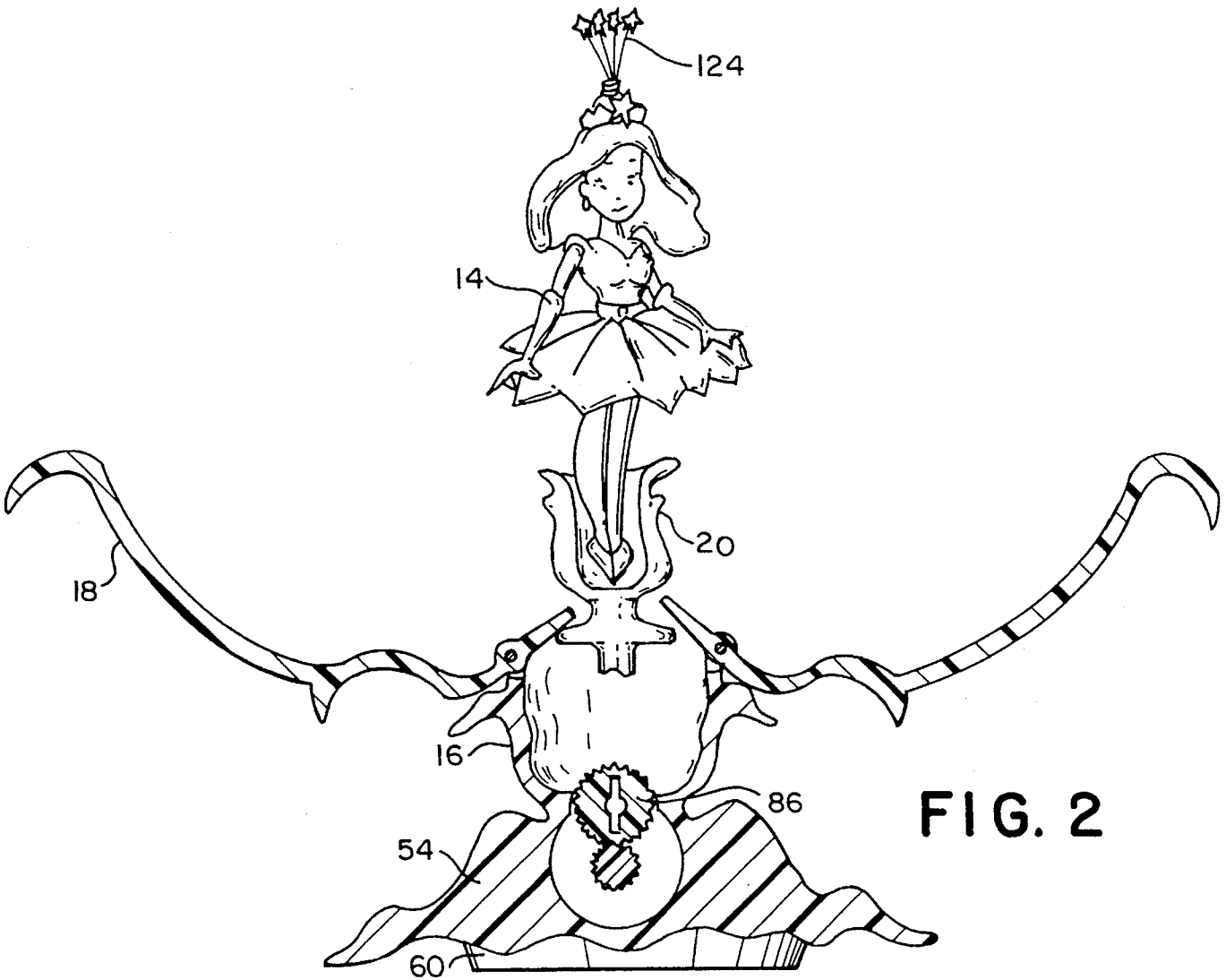
FIG. 2 is a cross-sectional side elevation view of the flower-doll of FIG. 1 in an open position.

Referring now to FIGS. 1 and 2, the preferred embodiment of the toy flower-doll 10 comprises a simulated flower 12 and a toy doll 14. The doll 14 is human-like in appearance and is generally designed to simulate a female fashion model. Other types of dolls or doll appearances may be employed if desired. The simulated flower 12 includes a center section, generally designated 16, shown in greater detail in FIG. 4. The simulated flower 12 also includes a plurality of petals 18 pivotally mounted to and generally surrounding the center section 16 for pivotal movement between an open position (FIG. 2) wherein the doll 14 is exposed and a closed position (FIGS. 1, 3) wherein the petals 18 generally surround and envelop the doll 14. A doll holder member 20 is disposed within the center section 16 to support the doll 14 preferably in a standing, upright position.

Figure 4:
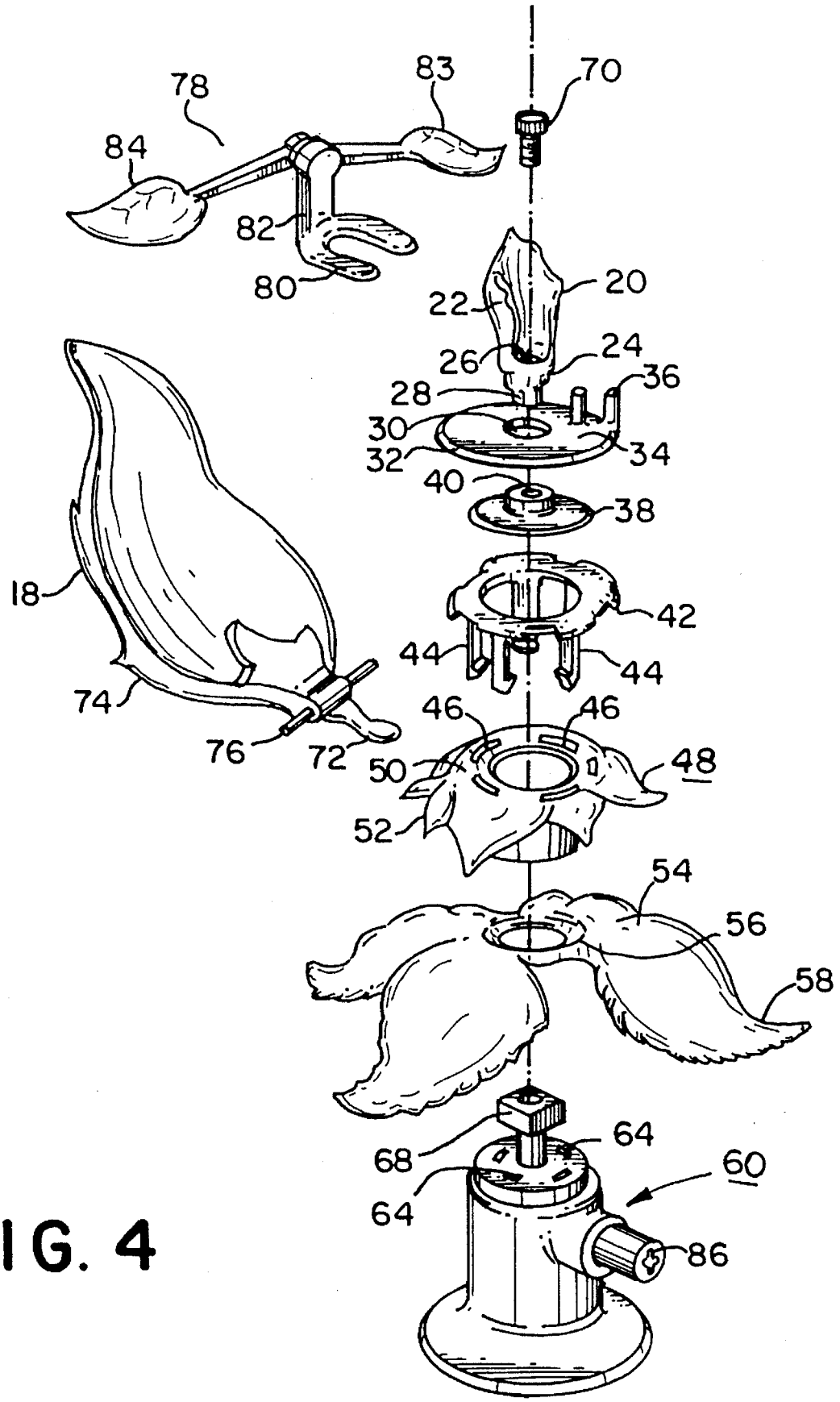
FIG. 4 is an exploded perspective view of some of the component parts of the simulated flower of FIG. 1.

FIG. 4 is an exploded perspective view showing some of the component parts of the simulated flower 12. The doll holder member 20 comprises a cylindrical shaped receptacle including fanciful side walls 22 and a base plate 24, the base plate 24 having a hole 26 in its center. The doll holder member 20 is preferably detailed to look like part of the simulated flower 12. The doll 14 is designed to stand inside the holder member 20, wherein the holder member sidewalls 22 surround the legs of the doll 14, extending upwardly to approximately knee height of the doll 14. The doll holder member 20 has a circular extension 28, of smaller diameter than holder member base plate 24, which extends downwardly, and is designed to insertably connect to a center opening 30 in a torus shaped petal holder member 32. The petal holder member 32 comprises a circular plate 34, having a hole 30 in a center portion and a plurality of pairs of flanges 36 which extend upwardly from the plate member 34. The torus shaped petal holder member 32 is insertably mounted on top of a circular plate member 38. The diameter of the circular plate member 38 is less than the diameter of the torus shaped petal holder 32. Circular plate member 38 has an opening 40 in the center thereof.

Figure 5:
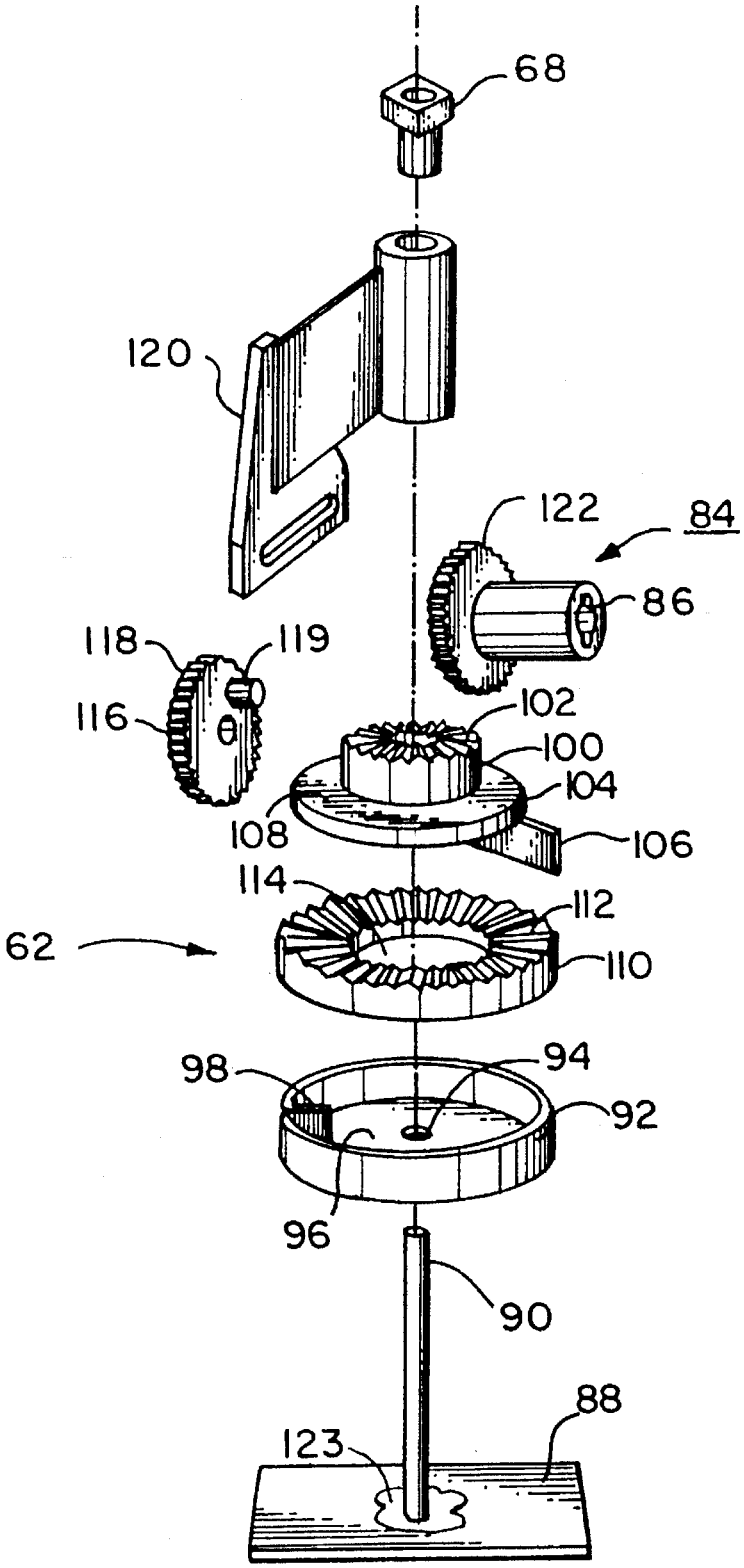
FIG. 5 is an exploded perspective view of a preferred embodiment of a mechanical movement for moving the flower-doll of FIG. 1 between the open and the closed positions.

A retaining ring assembly 42 is provided with a diameter which is substantially equal to the diameter of the petal holder 32. The ring 42 defines an opening which is large enough for the plate member 38 to pass through, yet not large enough for the petal holder 32 to pass through. The retaining ring assembly 42 comprises a ring with a plurality of locking clips 44 which extend downwardly generally perpendicular to the ring 42 and into a corresponding plurality of slots 46 in a calyx-like member 48. The calyx-like member 48 comprises a ring 50 having a plurality of short simulated leaves 52 extending outwardly from the ring 50. The retaining ring clips 44 project through and beyond the calyx member 48. The calyx member 48 is insertably mounted upon a leafy skirt member 54. The leafy skirt member 54 comprises a ring 56 and has a plurality of large simulated leaves 58 which extend outwardly therefrom. The leafy skirt member 54 is mounted on top of and covers a base member 60, which houses a drive mechanism 62 (FIG. 5). The leaves of the leafy skirt member 54 are much longer than the leaves of the calyx member 48. The retaining ring clips 44 project through the leafy skirt member 54 and into a plurality of holes 64 disposed around a top section of the base member 60, thereby locking the calyx member 48 and the leafy skirt member 54 to the base member 60.

The drive mechanism 62 has a main shaft 68 which extends upwardly from the base member 60. A fastener 70, in the form of a screw in the preferred embodiment, extends from the doll holder member 20, through the petal holder member 32, the plate member 38, the retaining ring 42, the calyx member 48, the leafy skirt member 54, and into threaded engagement with the drive mechanism main shaft 68. Although the screw 70 passes through the calyx member 48, the leafy skirt member 54, and the retaining ring 42, it is not in contact with these members, so that they are not engaged with the drive mechanism 62. In this manner, movement of the drive shaft 68 into or out of the base member 60 as hereinafter described, results in corresponding movement of the doll holder member 20.

The petals 18 each comprise a claw section 72, and a larger blade section 74, interconnected by a transverse hinge pin 76. The hinge pin 76 fits in pin receiving slots in the retaining ring 42. The larger blade section 74 of each petal 18 extends outwardly from the simulated flower 12, and the smaller claw section 72 extends inwardly, and into the opening within the retaining ring 42 center. Each claw section 72 is positioned between the plate member 38 and the petal holder 32. This provides the means for causing the petals 18 to pivot between the open and the closed positions. If the plate member 38 and petal holder 32 are raised by the drive shaft 68 moving out of the base member 60, the petal claws 72 are also raised, causing the petals 18 to pivot to the open position, thus lowering the petal blades 74. In reverse, if the plate member 38 and petal holder 32 are lowered by the shaft 68 moving into the base member 60, the petal claws 72 are lowered causing the petals 18 to pivot to the closed position, thus raising the petal blades 74. Due to the difference in diameters between the retaining ring 42 and the petal holder 32 versus the plate member 38, the plate member 38 may pass through the retaining ring 42, but the petal holder 32 cannot pass through retaining ring 42. Thus the retaining ring 42, acts as a stop to prevent further downward movement of the petal holder 32.

While the foregoing description discloses opening and closing the petals 18 via vertical movement, it is be appreciated by one of ordinary skill in the art that the petals 18 could be opened and closed by changing the means by which the petals 18 pivot, and then providing a horizontal motion to cause the petals 18 to be raised and lowered. Moreover, while a two-piece system 32, 38 is described to confine the claw members 72 of the petals 18 so that the petals 18 pivot as the plate member 38 and petal holder 32 are moved, a one-piece system could be substituted, which has an appropriate groove or channel to receive and hold the petal claw members 72. Additionally, means other than the retaining ring 42 with locking clips 44 could be substituted for securing the calyx member 48 and the leafy skirt member 54 to the base member 60 without departing from the scope of the invention.

The base member 60 supports the simulated flower 12 and houses the drive mechanism 62. The drive mechanism 62 (FIG. 5) is connected to the doll holder member 20 for moving the holder member 20 with respect to the petals 18 and consequently, to move the doll 14, and substantially simultaneously move the petals 18, between the open and closed positions.

Figure 6:
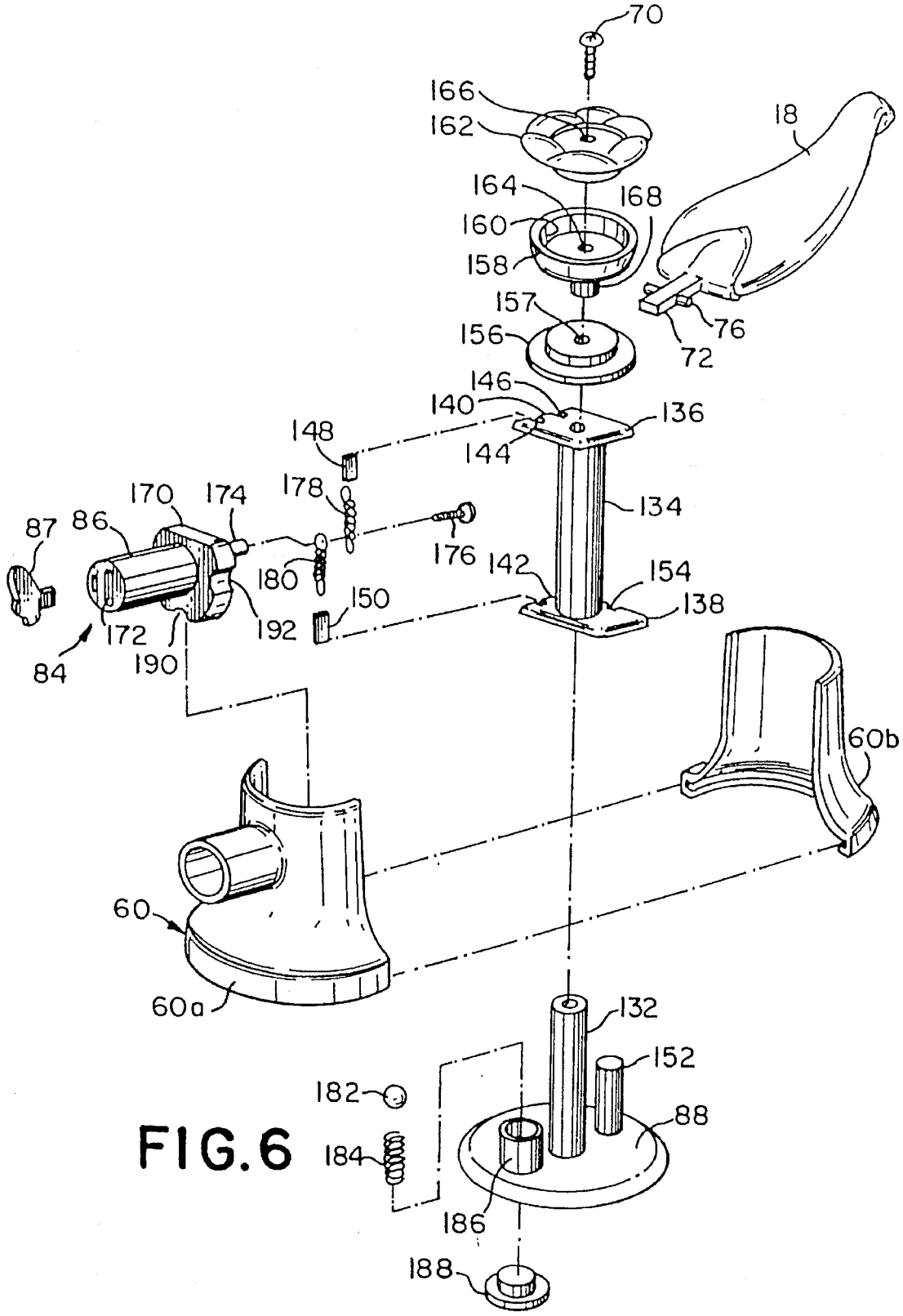
FIG. 6 is an exploded perspective view of an alternate embodiment of a drive mechanism for moving the flower-doll of FIG. 1 between the open and the closed positions.

An actuating member 84 acts upon the drive mechanism 62 to initiate drive mechanism operation. In the preferred embodiment, the actuating member 84 is located in a sidewall of the base member 60 and is easily accessible by a user. In the preferred embodiment, the actuating member 84 comprises a key operated shaft 86 which may be acted upon with a key 87 (FIG. 6). The shaft 86 is geared so that the shaft 86 and the key rotate no more than 120 degrees.

Referring now to FIG. 5, the drive mechanism 62 comprises a base plate 88 having a rod 90 centrally affixed perpendicular thereto. The rod 90 defines a longitudinal axis which projects through the component parts of the drive mechanism 62. A compression spring housing 92 having a center hole 94 is located on top of the base plate 88, with the rod 90 projecting through the hole 94. One or more compression springs 96 are disposed within the spring housing 92. Preferably, the springs 96 are one-piece torsional springs, made from music wire and are generally circular-shaped with a horizontal tab 98 on one end which projects inwardly toward the center of the spring housing 92.

A first crown gear 100 having teeth 102 is drivingly connected to the spring 96 by a plate 104 and a flange 106. The first crown gear 100 is affixed to one side of the plate 104, and the flange 106 is affixed to the other side of the plate 104. The diameter of the plate 104 is greater than the diameter of the first crown gear 100, such that a shelf 108 is provided by the excess diameter. When the drive mechanism 62 components are assembled, the first crown gear 100 is disposed within the spring housing 92 and the flange 106 is in engagement with the horizontal tab 98 of the spring 96. A second crown gear 110 having teeth 112 is provided having a large opening 114 in its center. The second crown gear 110 rests on top of the shelf 108 of plate 104, and the gear teeth 102 of the first crown gear 100 project through the large hole 114 in the second crown gear 110.

A geared cam wheel 116 having teeth 118 and a pin 119 is drivingly connected to the second crown gear 110. A cam slide 120, is interconnected between the main shaft 68 and the cam wheel 116 by the pin 119. The cam wheel 116 is employed for translating rotational movement to reciprocal movement by the movement of the pin 119 along the cam slide 120. An actuator gear 122 connected to the actuating member 84 is drivingly engaged with the first crown gear 100. When assembled, the base plate rod 90 extends perpendicularly from the base plate 88 through the spring housing 92, the first and second crown gears 100, 110 and the cam slide 120. A viscous fluid 123 is applied between the spring housing 92 and the base plate 88 to dampen movement therebetween.

In operation, rotation of the actuating member 84 causes the actuator gear 122 to rotate, which rotates the first crown gear 100, and consequently first crown gear flange 106. The flange 106 interacts with and loads the spring 96, and also rotates the second crown gear 110. The rotation of the second crown gear 110 rotates the cam wheel 116, which in turn, moves the pin 119 along the cam slide 120. The rotation of the cam wheel 116 is thereby translated to translational movement by the pin 119 and cam slide 120, which moves the main shaft 68. Movement of the main shaft 68 in an upward direction causes the interconnected plate 38, the torus shaped plate 32, the doll holder member 20, and the doll 14 to also move upwardly. The leafy skirt member 54, calyx-like member 48, and the retaining ring 42 remain stationary. The upward movement of the plate members 32, 38 correspondingly moves the claw portion 72 of the petals 18, causing the petals 18 to pivot, and thus move from the closed position (FIGS. 1, 3) to the open position (FIG. 2).

With the spring 96 now under tension, the movement can be reversed using the energy stored in the spring 96. Thus, the releasing of tension in the spring 96 causes the flange 106 to rotate, now in the opposite direction, rotating second crown gear 110, cam wheel 116, thus moving the pin 119 with respect to the cam slide 120. As the pin 119 moves along the cam slide 120 in the opposite direction, the main shaft 68 is lowered, consequently lowering the plates 32, 38, the doll holder 20, and the doll 14. As a result, the petals 18 are pivoted, moving from the open position to the closed position, wherein the doll 14 is enveloped by the large blade portion 74 of the petals 18.

Referring now to FIG. 6, an alternate embodiment of a drive mechanism for moving the flower doll 10 between the open and the closed positions is shown. The drive mechanism comprises a base plate 88 having a first guide rod 132 centrally affixed perpendicular thereto. The rod 132 provides a vertical support upon which a plunger 134 is slidably disposed. The plunger 134 has a top plate 136 and a bottom plate 138 affixed on opposing ends. Both the top plate 136 and the bottom plate 138 have tabs 140, 142 integral therewith and formed by cutting two parallel slots 144, 146, as shown for the top plate 136. The tabs 140, 142 provide a means for connecting top and bottom spacers 148, 150 to the top and bottom plates, respectively.

The base plate 88 is also provided with a second vertical guide rod 152 affixed perpendicularly thereon. The guide rod 152 is spaced from the first guide rod 132 and is approximately only half as tall as the first guide rod 132. The guide rod 152 functions to guide the plunger 134 when it slides up and down on the guide rod 132 and prevents the plunger 134 from rotating. The bottom plate 138 of the plunger 134 has a notch 154 cut out therefrom which partially surrounds the second guide rod 152, thus ensuring that the plunger 134 does not turn or rotate on the first guide rod 132 as it slides thereon.

A lower petal tab plate 156 having a hole 157 in its center is mounted on top of the plunger top plate 136. The lower petal tab plate 156 is similar to the previously described circular plate member 38 (FIG. 4). The lower petal tab plate 156 is shaped like two flat circular discs of different diameter, the smaller of the two discs disposed on top of the larger of the two discs. The diameter of the top disc being approximately two-thirds of the diameter of the bottom disc. An upper petal tab plate 158 is mounted on top of the lower petal tab plate 156. The upper petal tab plate 158 is circular in shape having a diameter approximately the same as the diameter of the bottom disc of the lower petal tab plate 156. The upper petal tab plate 158 has a recessed upper surface 160 which is adapted to receive a platform 162 upon which a toy doll can be affixed. The upper petal tab plate 158 and the platform 162 have holes 164, 166 in their centers. The upper petal tab plate 160 also has a hollow cylindrical spacer portion 168 attached perpendicular to its bottom surface. A fastener 70, in the present embodiment a screw, secures the platform 162, the upper petal tab plate 158, and the lower petal tab plate 156 to the top plate 136 of the plunger 134, so that the aforementioned elements move as one when the top plate 136 of the plunger 134 is moved along the guide rod 132. The fastener 70 extends from a top surface of the platform 162, and through holes 166, 164, 157, and into engagement with the top plate 136 of the plunger 134. Thus, the platform 162, the upper petal tab plate 158, the lower petal tab plate 156 and the plunger 134 are secured together for common movement.

The claw section 72 of the petal 18 is positioned between the lower petal tab plate 156 and the upper petal tab plate 158. As shown in FIG. 4, the transverse hinge pin 76 of the petal 18 is pivotally secured on top of the calyx member 48 by the retaining ring 42. Thus, the petals 18 pivot between the open position and the closed position as the plunger 134 is lowered and raised along the guide rod 132. For example, if the upper and lower petal tab plates 158, 156 are raised by the plunger 134 moving out of the base member 60, the petal claws 72 are also raised, causing the petals 18 to pivot to the open position, thus lowering the petal blades 74. In reverse, if the upper and lower petal tab plates 158, 156 are lowered by the plunger 134 moving into base member 60, the petal claws 72 are lowered causing the petals to pivot to the closed position, thus raising the petal blades 74.

The plunger 134 is actuated (raised and lowered) by an actuating member 84. The actuating member 84 in the present embodiment comprises a key operated shaft 86 located in an opening in the sidewall of the base member 60. In FIG. 6, the base member 60 is shown in two pieces **60*a*, 60*b* made, for example of plastic. The actuating member 84 has a cam 170 on one end and a key slot 172 on an opposite end. The key slot 172 is adapted to receive a key 87 therein. The cam 170 has a cam rod 174 which extends from the cam 170 toward the plunger 134. A fastener 176, in the form of a screw or rivet is adapted to be secured to the cam rod 174. First and second coil springs 178, 180 are each attached at one end by the fastener 176 to the cam rod 174, and at the opposite end to one of the spacers 148, 150. Thus, as the key 87 is rotated, the key shaft 86 rotates, in turn rotating the cam 170 and cam rod 174. The rotating cam rod 174 slowly and smoothly raises and lowers the plunger 134 by means of the bias force of the interconnected springs 178, 180**.

In addition, the movement of the plunger 134 is dampened and controlled by means of a detent comprised of a ball bearing 182 held in frictional contact with the cam 170 by a coil spring 184 disposed in a hollow cylindrical shaft 186 on the base plate 88. The shaft 186 is accessible from the bottom of the base plate 88 by means of a cap 188. The ball bearing 182 interacts with two notched recesses 190, 192 in the cam 170 which correspond to the closed position and the open position of the toy flower doll 10. The key operated shaft 86 of the alternate embodiment need only turn 90° to move the toy flower doll 10 between the open and closed positions. Moreover, two stops (not shown) are provided in the form of small nubs on the inside wall of the base member 60 which interact with a tab (not shown) on the cam to prevent the key shaft from being rotated greater than 90°. In order to aid the plunger 134 in moving slowly and smoothly, a viscous fluid, such as a thick grease may be applied to the outside surface of the first guide rod 132.

Figure 3:
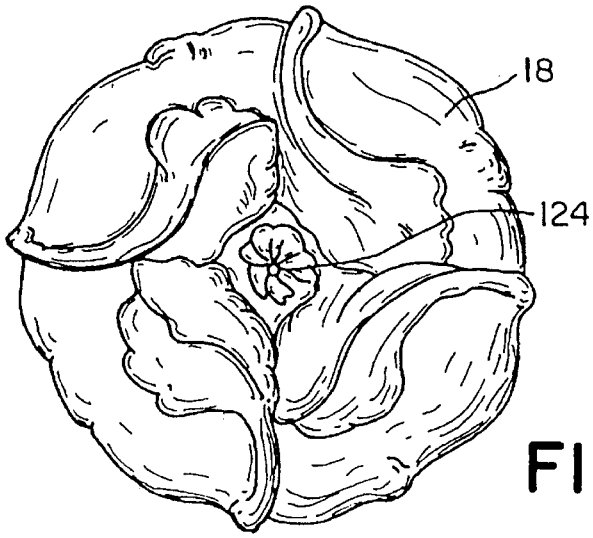
FIG. 3 is a top plan view of the flower-doll of FIG. 1 in the closed position.

FIG. 3 is a top view of the simulated flower 12 in the closed position. In this position, the doll 14 is generally hidden from view. In order to further simulate a flower and hide the doll 14 from the view of an observer, the doll 14 preferably has a plurality of stamen like filaments 124 located on a top surface of the doll 14. In addition to further hiding the doll 14 from view when the simulated flower 12 is in the closed position, the filaments 124 may be fancifully designed to further enhance the beauty of the doll 14 and the simulated flower 12.

As is also apparent in FIG. 3, the petals 18 overlap each other when the simulated flower 12 is in the closed position.

The simulated flower 12 may be designed using any number of petals as required to simulate a flower and/or sufficiently hide the doll 14 from view when the petals 18 are in the closed position. In the preferred embodiment, the toy flower-doll 10 comprises either four or five petal designs. It should be apparent to one skilled in the art that flowers with either more or less petals may be simulated and are within the scope of the invention.

A removable playset 78 (FIG. 4) comprising a U-shaped base 80 having a perpendicular flange 82 attached thereto, the flange 82 having a pair of leaves 83 pivotally hinged at the flange 82 distal end, is insertably connected between the doll holder member 20 and the petal holder member 32. The playset 78 is provided to add to the simulation of a real flower and to further conceal the doll 14 disposed within the simulated flower 12.

It is preferred that the elements and their components of the toy flower-doll 10, with the exception of any gears or springs (which are preferably constructed of a metallic material, such as spring steel) be constructed of a polymeric material. Specifically, it is preferred that the polymeric materials be polyvinyl chloride (PVC), and/or acrylonitrile-butadiene-styrene (ABS) resin. These polymeric materials provide the toy flower-doll 10 with a strong thermoplastic exterior with rigid, durable and lightweight components. However, it is understood by those skilled in the art that the above-mentioned elements and components could be constructed of other polymeric materials or materials having like qualities, such as, for example, polycarbonate, without departing from the spirit and scope of the invention.

Preferably, the above-mentioned elements and components of polymeric material of the toy flower-doll 10 are formed by standard molding processes as understood by those skilled in the art. However, it is also understood by those skilled in the art that other materials and processes could be used to construct the elements of the toy flower-doll 10, such as machining.

It is to be appreciated by the ordinarily skilled artisan that the presently claimed invention may include other components which are equivalent to those discussed specifically above. For example, the present invention includes a mechanical drive mechanism for the movement of the doll holder member 20. If desired, drive means equivalents such as other types of springs, spring linkages or a motor can be used. Actuating means can be formed with means other than a key operated shaft, such as a button or a lever which cooperate with appropriate lever(s) and/or linkage(s). The key operated mechanism could also be changed to an electronically actuated mechanism, wherein the electronics could be actuated in response to sound, light or motion. One of ordinary skill will be able to modify the preferred doll designs to simulate different dolls or figurines, for example, male action figures, or fantasy characters, such as trolls and fairies could be substituted for the female fashion models. It is also foreseen that different style flowers can be simulated, such as roses, or other popular blossoming flowers.

From the foregoing description, it can be seen that the present invention comprises a simulated flower and toy doll. It will be appreciated by those skilled in the art that changes could be made to the embodiment described above without departing from the broad inventive concepts thereof. It is understood, therefore, that this invention is not limited to the particular embodiments disclosed, but it is intended to cover all modifications within the spirit and scope of the present invention as defined by the appended claims.

We claim:

1. A simulated flower and toy doll apparatus comprising:

a toy doll;

a simulated flower including a center section having a holder member supporting the doll and a plurality of petals pivotally mounted to and generally surrounding the center section for pivotal movement between an open position wherein the doll is exposed and a closed position wherein the petals envelop the doll;

a drive mechanism connected to the holder member for moving the holder member with respect to the petals to move the doll, and for substantially simultaneously moving the petals between the open and closed positions;

a base member having a sidewall, the base member housing the drive mechanism and supporting the simulated flower;

an actuating member located in the base member side wall for operating the drive mechanism; and means for dampening movement of the drive mechanism so that movement of the doll and movement of the petals between the open position and the closed position is slow and smooth, wherein the drive mechanism comprises:

a base plate having a first guide rod extending perpendicularly thereto;

a plunger having a top plate and a bottom plate affixed on opposing ends thereof, the plunger being slidably disposed on the first guide rod;

a lower petal tab plate having a center hole, the lower petal tab plate being mounted on top of the plunger top plate;

an upper petal tab plate having a center hole and a recessed upper surface for receiving the doll holder member, the upper petal tab plate being mounted on top of the lower petal tab plate; and a fastener for securing the doll holder member, the upper petal tab plate and the lower petal tab plate to the top plate of the plunger, such that the doll holder member, the upper petal tab plate, the lower petal tab plate and the plunger are secured together for common movement; and wherein the actuating member includes a cam having a cam rod attached thereto, the cam rod extending from the cam toward the plunger;

a first coil spring attached at one end to the cam rod and at an opposite end to the plunger top plate; and a second coil spring attached at one end to the cam rod and at an opposite end to the plunger bottom plate, wherein rotation of the cam raises and lowers the plunger by means of the bias force of the interconnected springs.

2. The apparatus of claim 1 wherein the means for dampening movement comprises:

a hollow shaft affixed to the base plate;

a third coil spring disposed within the shaft; and a ball bearing disposed within the shaft and maintained in frictional contact with the cam by the third coil spring.

3. The apparatus of claim 1 wherein the means for dampening movement comprises a viscous fluid operatively interposed between the plunger and the first guide rod, the viscous fluid damping movement of the plunger with respect to the first guide rod.

4. The apparatus of claim 1 further comprising a second guide member spaced from the first guide rod and affixed to the base plate, wherein the plunger bottom plate includes a notch which partially surrounds the second guide member, so that the second guide member prevents rotational movement of the plunger on the first guide rod.

* * * * *